United States Patent [19]

Marcyan

[11] 4,202,062

[45] May 13, 1980

[54] KNOCK-DOWN INVALID BED

[75] Inventor: Stanley T. Marcyan, Glendale, Calif.

[73] Assignee: Marcy Tool Company, Glendale, Calif.

[21] Appl. No.: 923,243

[22] Filed: Jul. 10, 1978

[51] Int. Cl.[2] ..... A61G 7/10

[52] U.S. Cl. ..... 5/66; 5/285

[58] Field of Search ..... 5/63, 66–70, 5/92, 117, 189, 200, 202, 192, 285, 296, 317

[56] References Cited

U.S. PATENT DOCUMENTS

| | | | |
|---|---|---|---|
| 1,708,878 | 4/1929 | Goldberg | 5/192 |
| 1,775,547 | 9/1930 | Bayer | 5/69 |
| 2,566,541 | 9/1951 | Travis | 5/296 |
| 2,658,210 | 11/1953 | Travis | 5/68 |
| 3,245,092 | 4/1966 | Krewz | 5/68 |
| 3,612,042 | 10/1971 | Fry | 5/92 |
| 3,965,500 | 6/1976 | Stein, Jr. | 5/68 |

*Primary Examiner*—Casmir A. Nunberg
*Attorney, Agent, or Firm*—Sellers and Brace

[57] ABSTRACT

A knock-down invalid bed having a main frame supported at its ends by head boards and separable into two halves at its midlength. Attached to each half are pivoting sections of a pair of tubular mattress-supporting subframes adjustable to support a patient horizontally and in different angular positions. The subframes support two link fabric units separably interconnected crosswise of the midlength of the bed. Attached to the head board and overlying one end of the bed is a patient helper device to aid the patient in shifting his position in bed, and other useful functions.

5 Claims, 12 Drawing Figures

KNOCK-DOWN INVALID BED

This invention relates to knock-down beds, and more particularly to a lighter-weight mattress supporting assembly readily separable from the head board by improved coupling means and also separable at its mid-length into two subassemblies readily handled, assembled and disassembled by one person.

BACKGROUND OF THE INVENTION

Many proposals have been made for beds suitable for invalids and hospital patients which can be disassembled to facilitate transfer of the beds to different rooms, floors, and to and from the residence of a patient not in need of hospitalization. Modern versions of such beds embody various means for adjusting the mattress support between horizontal and different angular postions so important to the comfort and recovery of the patient. Typical U.S. Patents representative of prior constructions include Bayer No. 1,775,547, Stanley No. 3,281,873, Douglass No. 3,398,411, Benoit No. 3,818,518, Paine No. 3,919,727. In general, these prior constructions are not only complex and costly but the principal components are far too large and heavy to be handled, assembled and disassembled by one person. This becomes particularly costly and objectionable when moving the bed between different buildings or when transporting it between a place of use and a place of temporary storage. In each of the beds shown in the above patents, the main frame and mattress support comprises a single unit which is separable only from the two head boards.

Another shortcoming of the prior beds is the lack of a simple, high strength coupling interconnecting the main frame to the lightweight tubular stock conventionally used as the support legs for the head boards. The light gauge stock of these legs is not well suited to take the strains and stresses to which these couplings are subjected.

Beds for invalids also have need for patient helper devices overlying the head board and providing a hand grip or other device within reach of the patient and which he may grasp for assistance in changing position or in gaining some degree of exercise. Prior proposals for such devices are shown in Armstrong U.S. Pat. No. 2,057,811, Nichols U.S. Pat. No. 2,305,548, Rosessler U.S. Pat. No. 2,601,686 and Mayer U.S. Pat. No. 3,077,613. These devices serve a useful purpose but are unnecessarily complex and lack satisfactory provision for moving the horizontal arm to a position of safety and a compact retracted position when not in use.

SUMMARY OF THE INVENTION

This invention overcomes the foregoing and numerous other shortcomings and disadvantages of prior knock-down beds and embodies greater simplicity, a substantial reduction in weight and is so constructed that a minimum number of subassemblies are readily handled, assembled and disassembled by a single operator.

The main frame is made in two halves easily interconnected at the midlength of the frame. Each of the main frame units includes a lightweight but rugged mattress sub-frame formed of tubular elements to which a ligh-weight link fabric is resiliently connected by coil springs connected to perforated indentations formed along the inner sidewall of the tubular sub-frame. Each of the sub-frames is formed into subsections pivotally interconnected to with sections some of which are also connected to the halves of the main frame units. These pivoting sections are adjustable to different angular positions by separate manually manipulatable adjusting devices.

The remote ends of the main frame have an improved high strength coupling the female portion of which is a high strength member welded to the relatively light gauge material of the head board legs. The patient helper device comprises two tubular members hinged together in such manner that the horizontal leg is foldable when not in use compactly against the vertical supporting leg. This vertical leg is provided with simple clamping means for securing the same demountable to the head board.

Accordingly, it is a primary object of the present invention to provide an improved lightweight simplified knock-down invalid bed so constructed that its principal sub-components are readily handled, assembled and disassembled by one person.

Another object of the invention is the provision of a knock-down bed having an improved mattress supporting structure formed of tubular components resiliently supporting a link fabric cover in a plane bi-secting the frame.

Another object of the invention is the provision of a knock-down invalid bed having a lightweight mattress surporting structure in which link fabric is joined by tension springs to lugs formed between pairs of indentations or dimples along the inner side of a tubular frame.

Another object of the invention is the provision of an invalid knock-down bed having a main frame separable without tools at its midlength and having its opposite ends detachably coupled to the head boards by an improved, high strength coupling.

Another object of the invention is the provision of a knock-down bed having a main frame separable into two parts each including a related half of a tubular mattress sub-frame and which sub-frame halves include relatively pivotable sections.

Another object of the invention is the provision of a knock-down invalid bed having a detachable patient helper clampable to the head board and including a horizontal lever arm collapsible compactly against the upright support therefor.

These and other more specific objects will appear upon reading the following specification and claims and upon considering in connection therewith the attached drawings to which they relate.

Referring now to the drawings in which a preferred embodiment of the invention is illustrated:

Figures 1, 12:
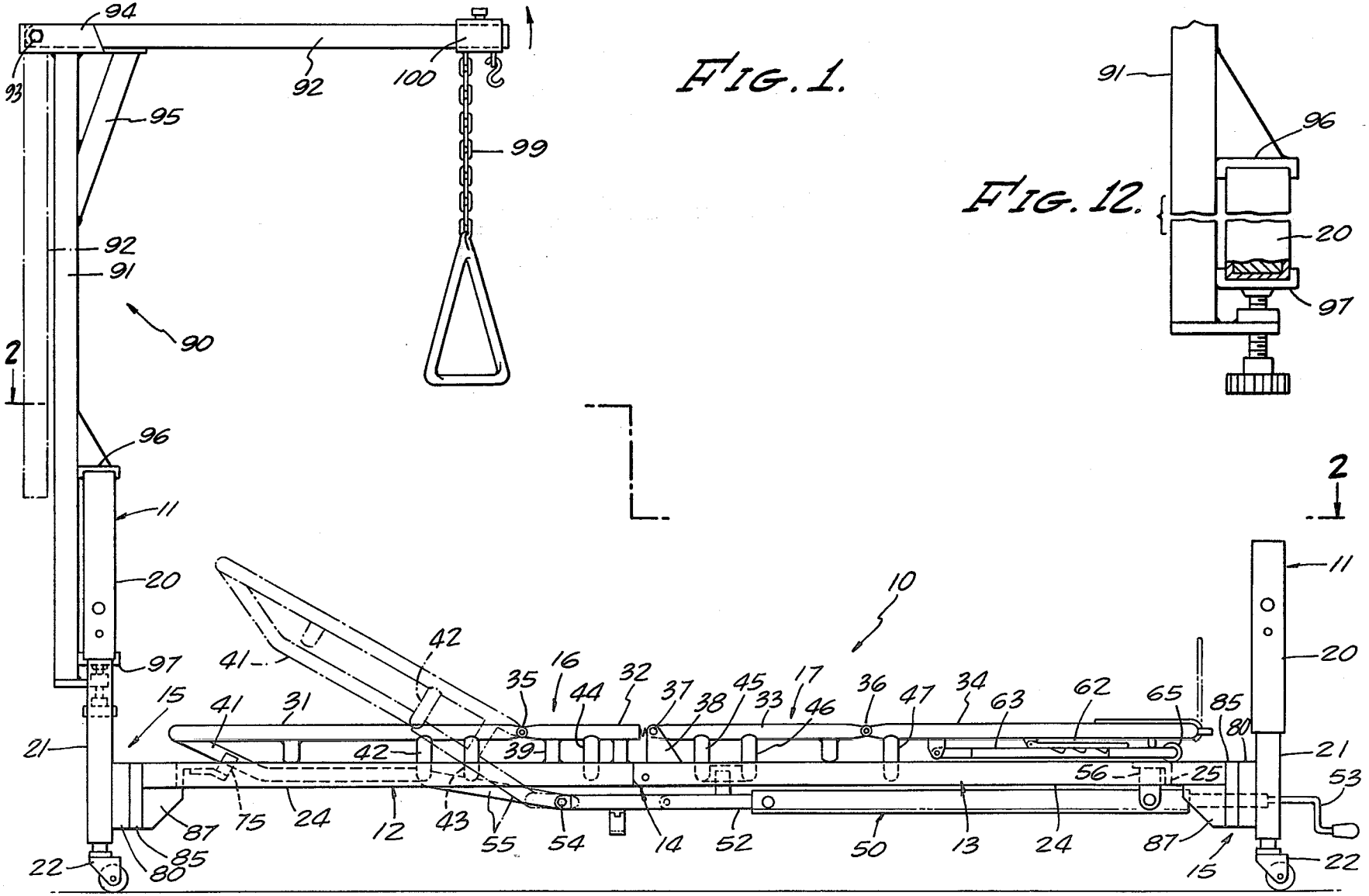
FIG. 1 is a side elevational view of an illustrative embodiment of the knock-down bed.
FIG. 12 is a fragmentary elevational view on an enlarged scale of the clamp holding the patient helper assembled to the head board.
Figure 2:
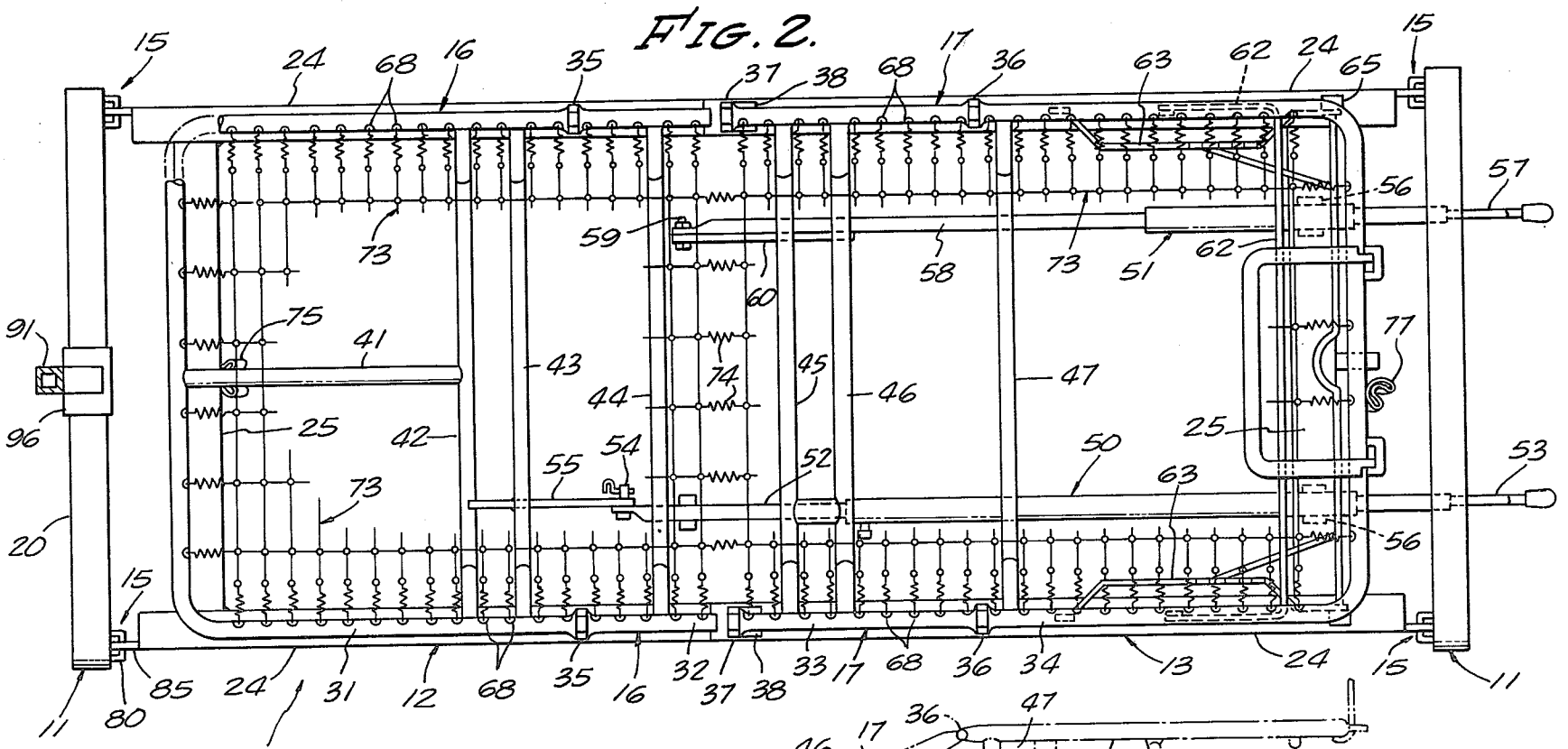
FIG. 2 is a horizontal cross-sectional view taken along line 2—2 on FIG. 1.
Figure 3:
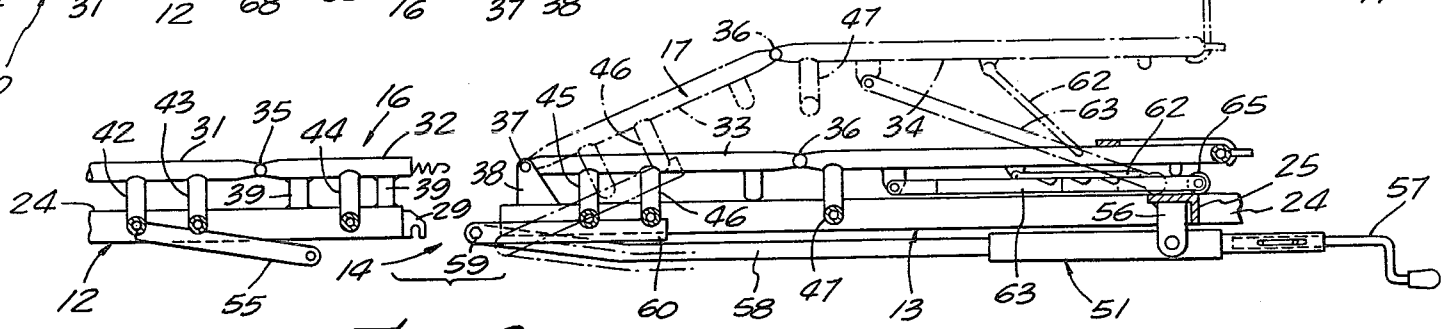
FIG. 3 is a fragmentary elevational view of the mid-section of FIG. 1 showing the two halves of the main frame separated and also showing in dot-and-dash line the mattress-supporting foot end of the sub-frame in one of its many angularly adjusted positions.
Figure 4:
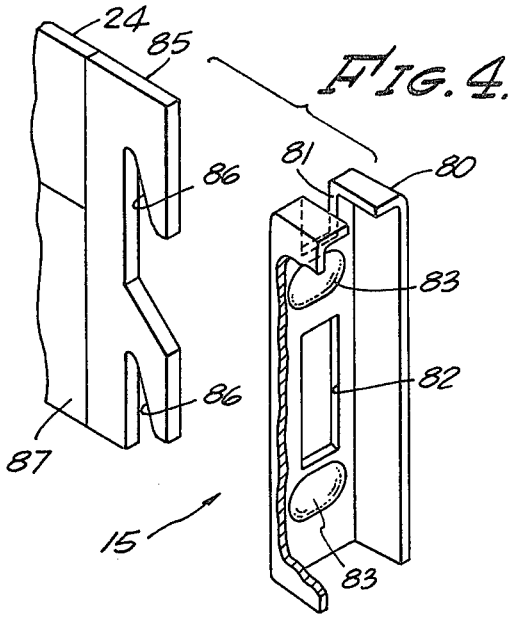
FIG. 4 is an exploded perspective view of the coupling holding one corner of the main frame to a head board.
Figure 6:
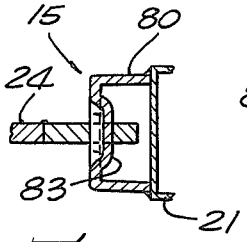
FIG. 6 is a cross-sectional view taken along 6—6 on FIG. 5.
Figure 5:
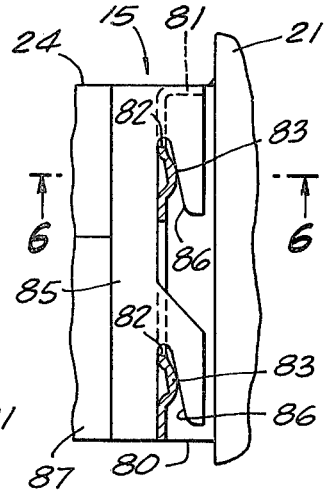
FIG. 5 is an elevational side view, partially broken away, of the FIG. 4 coupling in assembled position.
Figure 7:
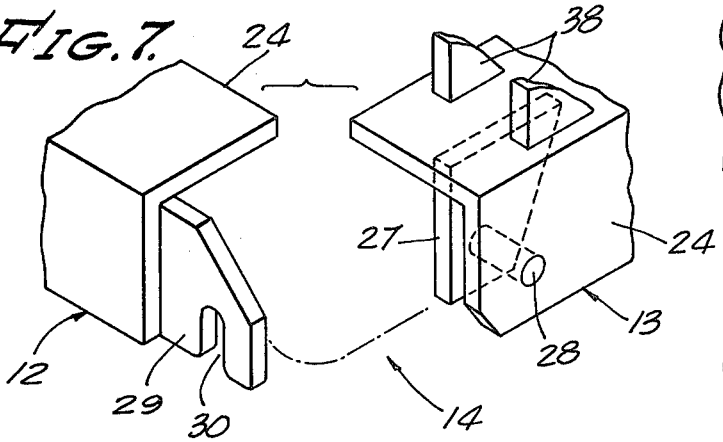
FIG. 7 is an exploded view of the separable coupling interconnecting the two halves of the main frame.
Figure 8:
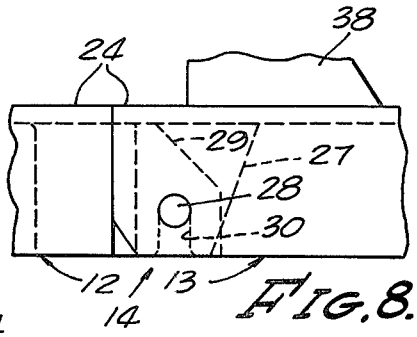
FIG. 8 is a side elevational view of the FIG. 7 coupling assembled.
Figure 9:
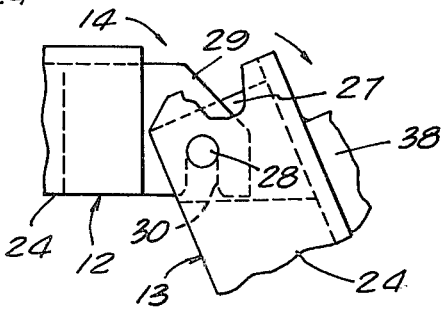
FIG. 9 shows the two parts of the FIG. 8 coupling rotated and in readiness for disassembly.

Referring initially more particularly to FIGS. 1–3, there is shown an illustrative embodiment of the bed, designated generally 10, comprising head boards 11,11 separably connected to the remote ends of the main frame sub-units 12,13. The midlength of the main frame is provided with a separable coupling the details of which are best shown in FIGS. 7–9 to be described presently. The remote ends of main frame halves 12,13 are separably connected to head boards 11 by separable couplings 15 the details of which are shown in FIGS. 4–5. Each of these halves or subassemblies is permanently connected to a respective half of the mattress supporting sub-frames 16,17. The perimeter and all braces of sub-frames 16,17 are formed of lightweight tubular components to be described in detail presently.

Headboards 11 include a rectangular panel enclosing a rigid frame supported at its opposite ends by sheet metal legs mounted on castors 22.

As best appears from FIG. 2, each half 12 and 13 of the main frame is U-shaped and comprises two legs or side members 24,24 interconnected at one set of ends by an angle iron cross member 25 welded thereto.

The separable coupling interconnecting the adjacent ends of main frame halves 12 and 13 are shown in FIGS. 7–9. As best appears from FIG. 7, the end of the angle iron member forming the leg of main frame unit 13 is provided with a vertical bracket 27 inwardly of and parallel to the vertical flange of angle iron 24 and cooperating therewith to support a detent pin 28. A hook member 29 is welded to the vertical flange of the angle iron 24 of the other main frame half 12 and its notch 30 is positioned to seat over detent pin 28. These components are so proportioned that when the two halves 12, 13 of the main frame are positioned as shown in FIG. 9, they can be pivoted into alignment with one another as shown in FIG. 8 with the adjacent ends of side members 24 in rigid abutting relation.

The tubular sub-frames 16 and 17 supporting the mattress, not shown, will now be described with reference to FIGS. 1–3, 10 and 11. Each sub-frame 16,17 is generally coextensive with the underlying half 12,13 of the main frame and all portions, except the link fabric 73 (FIGS. 1 and 10) are formed of lightweight, high strength tubular material. The two sub-frames 16,17 are discontinuous or spaced slightly from one another at their adjacent ends overlying the main frame couplings 14,14 the gap between these ends being best shown in FIGS. 2 and 10. Sub-frame 16 includes two sections 31,32 and sub-frame 17 includes two sections 33,34. The adjacent ends of sections 31,32 are hinged together by hinges 35 and sections 33 and 34 are hinged together by similar hinges 36. The left-hand ends of sub-frame section 33 are hinged at 37 to upright brackets 38 welded to the underlying end of main frame unit 13. Only sub-frame section 32 is rigidly secured to main frame unit 12 by tubular struts 39 (FIGS. 1 and 3).

The perimeter tubes of sub-frames 16,17 are provided with downwardly bowed reinforcing or bracing tubes 41 to 47, all except 41 of which extend crosswise of the bed. Bowed tube 41 extends between the midlength of tube 42 and the forward end of section 31. (FIG. 2)

Sub-frame section 31 underlying the patient's torso is adjustable upwardly about hinge 35 by manual adjusting means designated generally 50 (FIG. 2) whereas sub-frame sections 33, 34 are adjustable to different positions by the manual adjuster 51. Each of these adjuster assemblies is of generally conventional construction. For example, adjuster 50 includes a tubular housing enclosing a rod 52 having its inner end threaded and mating with a nut restrained against movement. The tubular housing of adjuster 50 is suspended from the underside of main frame 13 by a clevis 56 to provide limited freedom of movement therefor. Rod 52 can be rotated by the hand crank 53 at the foot of the bed thereby shifting rod 52 lengthwise of itself. The foremost end of rod 52 is connected by a removable pin 54 to a lever 55 rigidly welded crosswise of the bowed brace tubes 42,43 of sub-frame section 31. Pin 54 can be readily withdrawn when a cotter key or the like is withdrawn, an operation required only when disassembling the bed.

The manual adjuster 51 for sub-frame sections 33,34 is similarly constructed and its outer housing is likewise suspended from cross frame member 25 on a clevis 56. Its operating crank 57 similarly operates to reciprocate an operating rod 58 having its forward end pivotally connected by a bolt 59 (FIG. 2) to a strap 60 welded crosswise of tubular braces 45,46 as is best shown in FIGS. 2 and 3. Accordingly, the lengthwise movement of rod 58 by crank 57 acts to pivot sub-frame section 33 underlying the patient's legs about the axis of hinges 37. If the patient wishes his feet to be supported horizontally, or at some angle thereto, the nurse or other attendant may manually lift the right hand end of section 34 and position the strut 62 in one of the notches formed along the length of cooperating strut 63. The upper ends of both of struts 62,63 are hinged to the underside of section 34 in the manner shown in FIG. 3 but strut 63 is longer and its free end is provided with rollers positioned to ride along the side or leg members 24 of the main frame. It will therefore be clear that sub-frame section 34 may be supported at various angles to accommodate the patient's wishes.

An important feature of the sub-frame assembly is the fact that the inwardly facing sides of its perimeter tubes are indented or dimpled at 68,68 to form a lug 69 lying in a generally diametric plane transversely of the tubes. These lugs are perforated as indicated at 70 to receive the hooked end of tension springs connecting all perimeter portions of the link fabric 73 to the mattress supporting sub-frame. The expedient just described provides a simple, rugged mode of providing a connection between the link fabric and the perimeter tubes of the mattress supporting sub-frame. It will be evident from FIGS. 10 and 11 that the upper side of strings 72 lie in the same general plane as the top side of the perimeter tubes thereby greatly minimizing the risk of damage to portions of the mattress in contact therewith.

Figure 10:
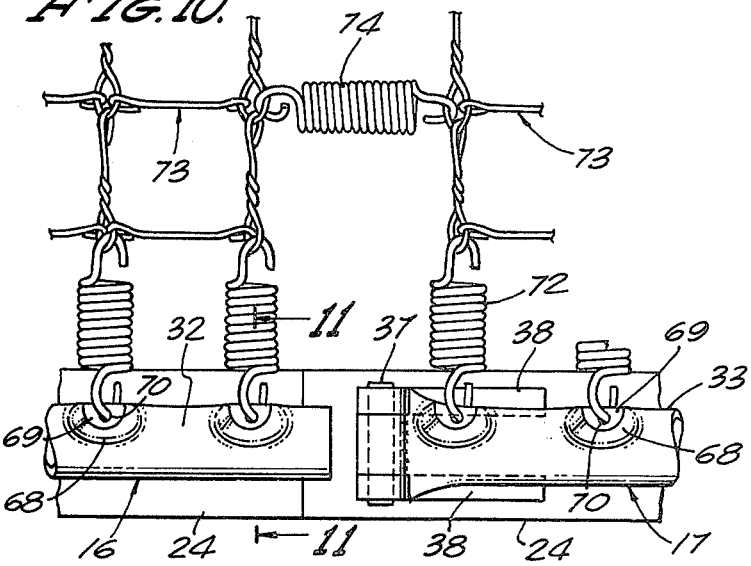
FIG. 10 is a fragmentary planned view of the mattress sub-frames in the area overlying the separable coupling between the main frame halves.
Figure 11:
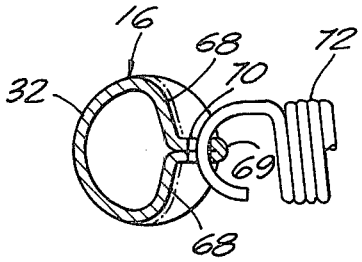
FIG. 11 is a fragmentary cross-sectional view taken along line 11—11 on FIG. 10.

It will also be understood from FIGS. 2 and 10 that the link fabric 73 is divided into two halves connected respectively to the two sub-frames 16 and 17 with their mid-length ends terminating adjacent one another.

These ends are interconnected detachably by a plurality of tension springs 74 one end of which is preferably permanently connected to one of the link fabric halves and the other end of which is manually disengageable by the operator when demounting the bed components.

Before leaving the description of the mattress sub-frames it should be pointed out that the head end of the main frame 12 is preferably equipped with a U-shaped spring clip 75 positioned to grip sub-frame brace 41 and hold section 31 captive when demounting the bed components for transfer to another location. This prevents sub-frame section 31 from pivoting when the manual adjuster subassembly 50 is disconnected from lever arm 55. Likewise, another spring clip 77 (FIG. 2) attached by a chain to the main frame is engageable over the front end of section 34 to hold it captive for the same reasons just mentioned in connection with clip 75.

Referring now to FIGS. 1, 2 and 4 through 6, coupling 15 separably securing the main frame units 12 and 13 to head boards 11 will be described. This coupling comprises a channel-shaped female member having the edges of its flanges welded to the relatively lighter gauge tubular member of the head board post 21. The upper end of the channel's side flanges is preferably turned inwardly to avoid risk of injury to the patient and other persons. These inturned edges cooperate to form a slot 81 which extends downwardly a short distance along the web portion of the channel member and is aligned with a second underlying slot 82. The portion of the channel web immediately below the lower end of each of slots 81,82 is dimpled or depressed inwardly to provide camming surfaces 83. The adjacent ends of the vertical flanges of angle iron member 24 of the main frame halves 12 and 13 are equipped with a male coupling member 85. This member comprises an elongated strip having a pair of V-shaped notches 86,86 opening downwardly through its outer vertical edge. The inner edges of the two V notches are in general vertical alignment with one another whereas the outer edges of these notches are inclined acutely to the vertical as best appears in FIGS. 4 and 5.

The mode of assembly of the main frames to the head boards will be clearly evident from the foregoing description of couplings 15. The male members 85 of the main frame sections are guided into slots 81,82 and then lowered as the camming surfaces 83 cooperate with the inclined edges of V notches 86 to cam the vertical edges of the V slot firmly against the web portions of channel members 80. When so assembled the upper edges of male members 85 are flush with the inturned tabs at the upper ends of the channel members 80. Separation of the coupling is accomplished by lifting upwardly on the side frames adjacent couplings 15 and tapping the head board downwardly.

Preferably and as herein illustrated, the width of channel members 80 corresponds to the width of bed leg 21 and the wall thickness is typically very substantially greater or double the thickness of the sheet metal constituting the tubular legs 21. Typically, the gauge of the leg metal is approximately 50 mils whereas the gauge of the channel material is double that. Also the channel length corresponds with that of the male coupling member 85 which is substantially greater than double the vertical height of the side flange of main frame member 24 and the major portion of the lower end of member 85 is reinforced by a bracket 87 (FIG. 1). It will therefore be recognized that the heavy duty components of coupling 15 provide an exceptionally strong separable connection between the main frame and the relatively light gauge material of the tubular head board supporting leg 21.

The patient helper device, designated generally 90 and illustrated in FIGS. 1 and 12, comprises a tubular upright 91 and an arm 92 pivotally connected to its upper end by a pivot pin 93. This pivot pin is mounted in an upwardly facing channel-shaped socket member 94 welded crosswise of the upper end of upright 91. A bracket member 95 extends between the right hand end of member 94 and upright 91 to provide a very sturdy and rugged support for arm 92. Pivot pin 93 is so located that arm 92 can be pivoted counterclockwise to the non-operating retracted position shown in dot and dash lines in FIg. 1. This is readily carried out by rolling the bed away from the wall. Upright 91 is held to the bed head board 11 by a clamping jaw 96 embracing the top edge of the head board panel 20 and by a manually operated adjustable clamping jaw 97 embracing the lower edge of this panel. Various devices may be supported along the length of arm 92 such as the hand grip 98 suspended by a cord or chain 99 from the tubular member 100 slidable along arm 92. It will therefore be recognized that patient helper 90 comprises a main body having but two parts readily folded compactly together when not needed or to a firm and rigid operating position. In neither position does arm 92 present any hazard to the patient or to those caring for the patient.

While the particular knock-down invalid bed herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. That improvement in a knock-down bed having a main frame detachably supported at its ends by head boards and readily separable into two halves at the midlength thereof which comprises:

each half of said main frame including a mattress support comprising link fabric means resiliently supported along its sides and at one end by a respective tubular sub-frame and including coil spring means detachably interconnecting the adjacent end halves of said link fabric means; and said tubular frame including a plurality of tubular struts having the major portion thereof spaced below and extending crosswise of said link fabric means with their ends rigidly fixed to the sides of said tubular sub-frame at spaced apart points therealong.

2. That improvement defined in claim 1 characterized in that each of said tubular sub-frames is formed with a multiplicity of opposed perforated dimples distributed along the inwardly facing sides of said sub-frames to which said link fabric means is attached.

3. That improvement defined in claim 1 characterized in that each of said sub-frames is formed in first and second halves hinged together crosswise of said bed, said second halves being adjacent the opposite ends of said bed, one of said first halves being fixed to said main frame and the adjacent section of the other of said first halves half being pivoted to said main frame, and separate manually operable means for adjusting the positions of the pivotable halves of said sub-frames.

4. That improvement defined in claim 1 characterized in the provision of separable coupling means connecting the halves of said main frame to said head boards, said head boards having tubular supporting legs, channel-shaped female coupling members extending vertically of an exterior face of said legs and having the edges of its side flanges welded to said legs, the web portions of said female members having a pair of vertical slots spaced closed above inwardly-protruding camming surfaces, and the adjacent ends of said main frame members having male coupling members fixed thereto equipped with a pair of downwardly extending hooks positioned to seat in said slots and against said camming surfaces to hold said head boards rigidly but separably assembled to said main frame.

5. That improvement defined in claim 1 characterized in the provision of patient helper means detachably secured to and mounted on one of said head boards and having a tubular upright extending upwardly very substantially above the head board, a tubular arm pivoted at one end to the top of said upright for movement between a retracted position against said upright and a firmly supported extended operating position overlying said bed, and means suspended from the other end of said arm positioned to be grasped by a patient as an aid to changing the patient's position in bed.

* * * * *